US008028672B2

(12) United States Patent
Prior et al.

(10) Patent No.: US 8,028,672 B2
(45) Date of Patent: Oct. 4, 2011

(54) DRY SUMP OIL TANK ASSEMBLY FOR A VEHICLE

(75) Inventors: Gregory P. Prior, Birmingham, MI (US); Akram R. Zahdeh, Rochester Hills, MI (US); Robert S. McAlpine, Lake Orion, MI (US); Bryce E. Mazzola, Dryden, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 837 days.

(21) Appl. No.: 12/038,068

(22) Filed: Feb. 27, 2008

(65) Prior Publication Data

US 2009/0211552 A1 Aug. 27, 2009

(51) Int. Cl.
*F01M 1/10* (2006.01)

(52) U.S. Cl. ..... 123/196 R

(58) Field of Classification Search ..... 184/6.5, 184/6.8, 6.9, 6.13; 123/196 R, 196 A; 96/195, 96/209

See application file for complete search history.

(56) References Cited

U.S. PATENT DOCUMENTS

| | | | | |
|---|---|---|---|---|
| 2,584,877 | A * | 2/1952 | Hoffman et al. | 123/196 AB |
| 2,753,011 | A * | 7/1956 | Downs | 96/211 |
| 7,017,546 | B1 | 3/2006 | Patel et al. | |
| 2006/0124099 | A1 * | 6/2006 | Richards | 123/196 R |
| 2007/0163442 | A1 * | 7/2007 | Saito et al. | 96/209 |
| 2008/0179227 | A1 * | 7/2008 | Saito | 210/109 |

* cited by examiner

*Primary Examiner* — M. McMahon
(74) *Attorney, Agent, or Firm* — Quinn Law Group, PLLC

(57) ABSTRACT

A dry sump oil tank assembly for a vehicle is provided with a housing defining an internal cavity. The housing is configured with a laterally-extending portion to add lateral volume to the internal cavity and has at least one internal baffle attached to the housing within the internal cavity below the laterally-extending portion and configured to reduce sloshing of oil within the cavity. The dry sump oil tank assembly is particularly useful for high performance applications, such as racing vehicles, and may utilize components from standard vehicle applications, thus maximizing the economies of scale of producing such components and being suited for a vehicle that may be typically used in standard driving conditions, but occasionally subjected to high performance use.

9 Claims, 2 Drawing Sheets

DRY SUMP OIL TANK ASSEMBLY FOR A VEHICLE

TECHNICAL FIELD

The invention relates to a dry sump tank assembly that has at least one internal baffle configured to reduce oil slosh and extended lateral volume to allow a higher level of oil during operation.

BACKGROUND OF THE INVENTION

Lubrication systems for internal combustion engines on passenger vehicles may be wet or dry sump lubrication systems. A wet sump lubrication system is typically used on production vehicles. Lubricant is stored beneath the crankshaft and oil pan. The oil pan needs to be large and deep in order to hold sufficient amounts of lubricant, such as oil, to lubricate the engine.

Dry sump lubrication systems utilize an external tank to store some of the oil outside of the engine. Accordingly, a large and deep oil pan under the engine is not required. Therefore, the main mass of the engine may be placed lower in the vehicle. Dry sump lubrication systems are commonly used with high-performance engines, such as racing vehicles.

In vehicles with a dry sump lubrication system, oil is pumped from the external oil tank or reservoir to bearings or other parts of the engine that require lubrication. Oil that is thrown from the crankshaft bearings during operation of the engine drains to the sump located in a lower part of the crank case. Oil received in the sump is pumped back to the oil tank by a scavenge pump. This oil contains a large quantity of entrained air, which is absorbed into the oil due to splashing during the lubricating process. Entrained air lowers the lubricating efficiency of the oil. A deaerator or air separator is sometimes provided in the external oil tank to deaerate the oil so that oil returning from the oil tank to the engine is deaerated.

SUMMARY OF THE INVENTION

A dry sump oil tank assembly is provided for lubricating an engine, and is suitable for a high performance vehicle, such as a racing vehicle or for a standard passenger vehicle that may occasionally be subjected to high-performance conditions. The dry sump oil tank assembly includes a housing that defines an internal cavity. The housing is configured with a laterally-extending portion in order to add lateral volume to the internal cavity. Thus, the overall volume of the internal cavity is increased without necessarily increasing the height of the housing. Additionally, sufficient oil volume is present to address drain down, without unnecessarily increasing the oil level when the engine is not in operation. Accordingly, a positive crankcase system secured to an air separator near the top of the dry sump oil tank assembly will not be contaminated by oil due to a high oil level when the engine is not in use or is under low speed operation.

The dry sump oil tank assembly also includes at least one internal baffle that is attached to the housing within the internal cavity below the laterally-extending portion. The baffle is configured to reduce sloshing of oil within the cavity, thus preventing oil pickup issues that would occur if an oil pickup or an oil inlet near the bottom of the housing were to become uncovered during high speed maneuvers (e.g., turns, braking, acceleration, etc.) of the vehicle.

A first internal baffle may be integrated within an upper housing portion of the tank assembly that forms the extended lateral volume. This first baffle is angled toward the bottom surface of the housing and has a vent opening to allow air to vent from below the baffle. Another internal baffle may be secured to the housing below the first internal baffle, and may have openings arranged in concentric circles. In some embodiments, the openings each have a diameter not less than 2 millimeters and not more than 10 millimeters, with a total area of the openings being approximately, but not limited to, 16 percent of the total area of the internal cavity at a lateral cross section taken at the baffle. Such an arrangement minimizes oil slosh during high-speed turns.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
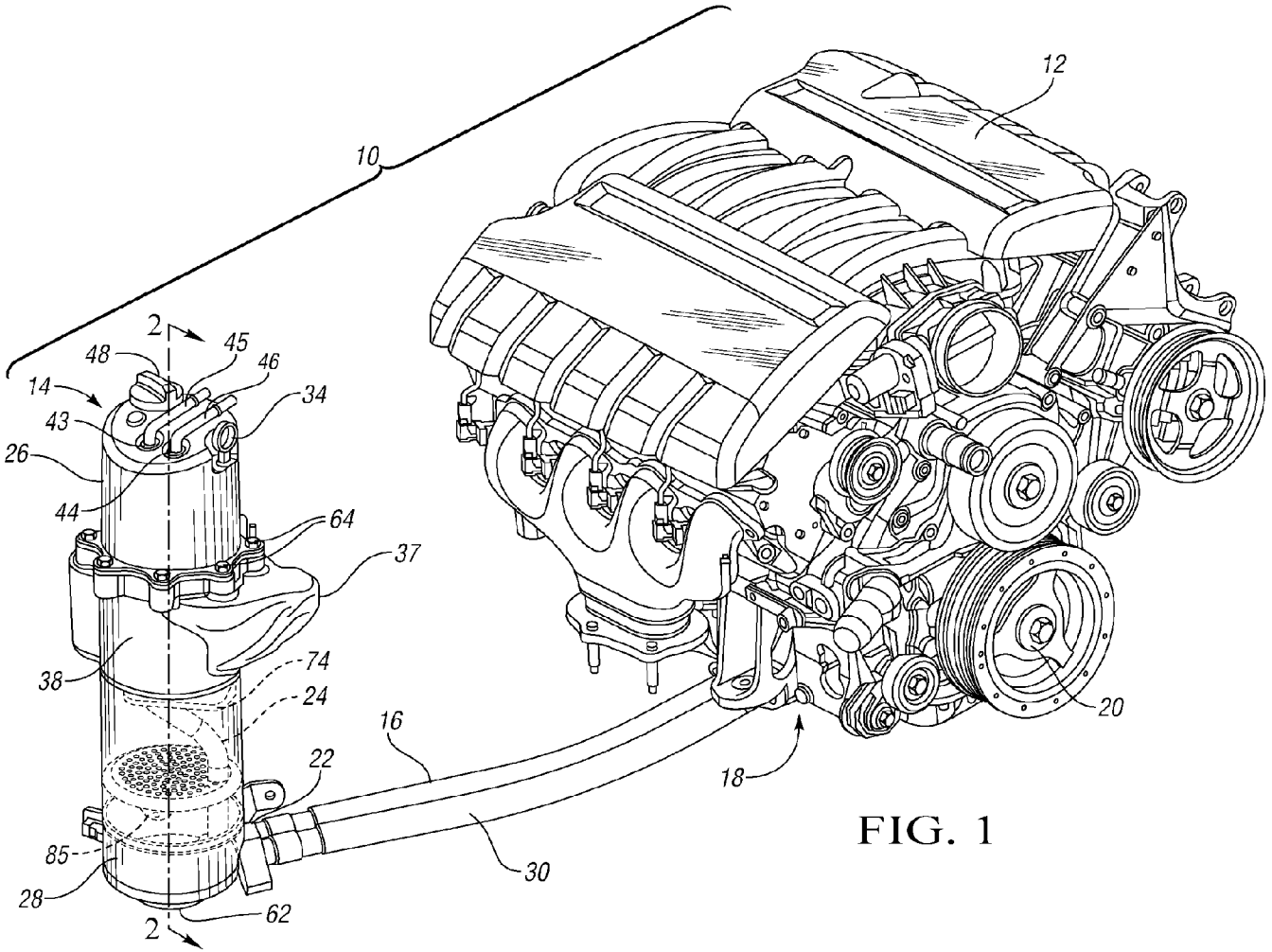
FIG. 1 is a schematic perspective illustration of a portion of a vehicle including an engine and a dry sump oil tank assembly in fluid communication with the engine.

Referring to the drawings wherein like reference numbers refer to like components, FIG. 1 shows a portion of a vehicle 10 including an engine 12 connected with a dry sump oil tank assembly 14. An oil supply hose 16 feeds oil collected in a sump 18 at the bottom of the engine 12 to the dry sump oil tank assembly 14. A pump assembly, not visible in FIG. 1, driven by the engine crankshaft 20 forces the oil through the oil supply hose 16 to an oil inlet 22 of the dry sump oil tank assembly 14. A connecting hose 24 directs oil from the oil inlet 22 to a separator 26, where the oil is deaerated and air for a positive crankcase ventilation (PCV) system is separated from any entrained oil, as discussed further with respect to FIG. 2. The deaerated oil drains to a lower housing portion 28, where it is returned via an oil return hose 30 to the oil pump assembly for reuse in lubricating the engine 12. The pump assembly includes a pressure section that draws the deaerated fluid from the dry sump oil tank assembly 14 via return hose 30 to the engine 12. The pump assembly also includes a scavenge section, which supplies the aerated oil via connecting hose 24 to the dry sump oil tank assembly 14, as is known to those skilled in the art.

Figure 2:
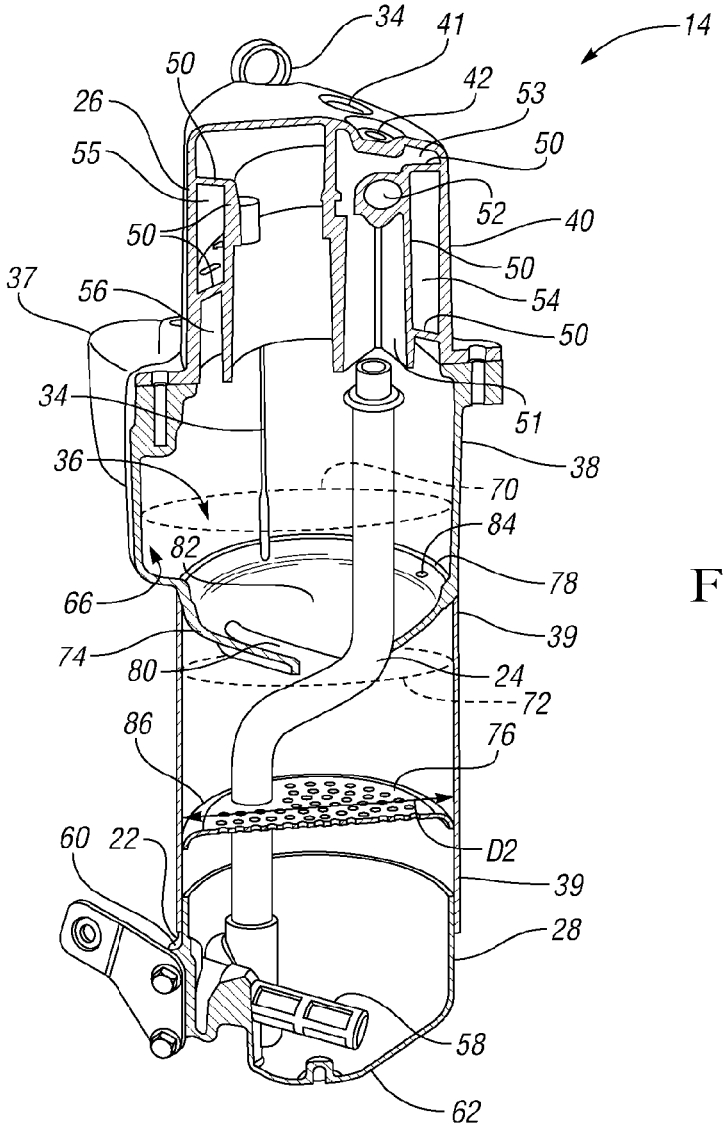
FIG. 2 is a schematic perspective cross-sectional illustration of the dry sump oil tank assembly taken at the line 2-2 in FIG. 1.

Referring to FIG. 2, the dry sump oil tank assembly 14 has an oil measuring device 34. The oil measuring device 34 is a dipstick in this embodiment, but may be any other type of oil measuring device commonly used. The oil measuring device 34 is mounted to the air separator 26, and extends through an opening therein, into an internal cavity 36 formed by the air separator 26, the lower housing portion 28, an upper housing portion 38, and an extension portion 39 connected between the upper and lower housing portions 38, 28, respectively, as shown in FIG. 2. The upper housing portion 38, lower housing portion 28, and extension portion 39 together form a housing 40 of the dry sump oil tank assembly 14. The air separator 26 also includes openings 41, 42 (shown in FIG. 2), that support PCV structure forming ports 43, 44 (i.e., orifices) (shown in FIG. 1) representing a PCV system. The PCV ports 43, 44 direct air within the air separator 26 through ventilation tubes 45, 46, respectively, to remaining components (not shown) of the PCV system. An oil fill cap 48 (shown in FIG. 1) is also supported and mounted to the air separator 26.

Referring to FIG. 2, internal baffling 50, formed by or integrated within the air separator 26, is configured to deaerate the oil supplied through the connecting hose 24. The internal baffling 50 includes a vertical guidance portion 51, which guides the oil from connecting hose 24 through an opening 52 to an upper passage 53. The internal baffling 50 is configured to create a spiraling flow path that spirals the oil downward through the air separator 26, causing the oil to impinge against the internal baffling 50 and interior walls of the air separator 26, thereby deaerating the oil. Specifically, the oil flows through a continuous spiral to a middle portion 55 of the spiraling passage to a lower portion 54 of the spiraling passage to an exit portion 56 from which the oil flows downward through the upper housing portion 38 to the lower housing portion 28 and is collected around an oil pickup 58 connected with the oil return hose 30 of FIG. 1.

As is apparent in both FIGS. 1 and 2, the oil inlet 22 and oil pickup 58 are at a side 60 of the lower housing portion 28, above the bottom surface 62 of the lower housing portion 28. The lower housing portion 28 forms an ice condensate trap such that any condensate within the dry sump oil tank assembly 14 will freeze below the oil inlet 22 and pickup 58, thus not interfering with oil flow to and from the dry sump oil tank assembly 14.

As is apparent to those skilled in the art, the above-mentioned features of the air separator 26 and the lower housing portion 28, that is, the oil measuring device 34, the PCV ports 43, 44, the side-mounted oil inlet 22 and the bottom surface 62 forming an ice condensate trap make the air separator 26 and the lower housing portion 28 useful for production, standard performance, vehicles. Thus, economies of scale may be realized by producing the air separator 26 and the lower housing portion 28 for standard vehicles, and welding these directly together without the upper housing portion 38 and the extension portion 39, which provide utility mainly for high-performance vehicles, as discussed below. For high-performance vehicles, the air separator 26 is welded or connected with fasteners 64 (multiple fasteners shown in FIG. 1) to the upper housing portion 38 which is welded to the extension portion 39, which is in turn welded to the bottom housing portion 28. The dry sump oil tank assembly 14 is thus also suited for a vehicle that may be typically used in standard driving conditions, but occasionally subjected to high performance use.

Referring to FIG. 2, the dry sump oil tank assembly 14 also includes several features specifically designed for high-performance vehicle applications, such as racing vehicles. First, the upper housing portion 38 has a laterally-extending portion 37, with a noncylindrical shape extending laterally further outboard than the generally cylindrically-shaped air separator 26, extension portion 39 and lower housing portion 28. Specifically, the laterally-extending portion 37 provides extended lateral volume 66 of the internal cavity 36. The extended lateral volume 66 may also be referred to as auxiliary cavities, and increases the oil holding capacity of the dry sump oil tank assembly 14. This addresses the phenomenon of "draw down" where an operating level of the oil is higher within the dry sump oil tank assembly 14 when the vehicle is not in use, but is lowered when in use, as the oil is routed through the entire lubrication system. Severe draw down will cause the operating level of the oil to be insufficient, such that the oil inlet 22 and oil pickup 58 may be uncovered during high speed maneuvers, resulting in an undesirable drop in oil pressure. With a higher operating level enabled by the extended lateral volume 66 of the upper housing portion 38, even with draw down, the in-use oil operating level is high enough such that the oil inlet 22 and oil pickup 58 do not become uncovered. An exemplary oil level 70 for an engine that is not in use and an engine in-use operating oil level 72 are indicated in FIG. 2 to illustrate the phenomena of draw down. The extended lateral volume 66 permits a sufficiently high in-use operating oil level 72, while minimizing the height of the out-of-use oil level 70, as measured upward from the bottom surface 62 (assuming that the dry sump oil tank assembly 14 is generally vertically-installed on a vehicle), so that oil does not contaminate the PCV separator 26 of FIG. 1 (such contamination is referred to as "pull over"). The extended lateral volume 66 is "nonuniformly distributed" in that it is an irregular lateral protrusion that is not symmetrical about a central axis of the generally cylindrical portions of the housing 40.

The dry sump oil tank assembly 14 also incorporates internal baffles 74, 76, which address the problem of oil slosh that is exacerbated in high-performance vehicles due to high speed maneuvers. The internal baffle 74 is an integral annular baffle, referred to herein as a first annular baffle, and is cast as part of the upper housing portion 38. The integral annular baffle 74 has an outer periphery 78 and an inner periphery 80, with a baffle surface 82 angling downward from the outer periphery 78 to the inner periphery 80. The inner periphery 80 is a generally elongated slot in this embodiment, sized to allow the connecting tube 24 to extend therethrough. The shape of the internal baffle 74 is determined at least in part by the shape of the connecting tube 24. The angle of the baffle surface 82 is determined by the oil slosh angle at maximum side loads caused by vehicle acceleration or turning. As is apparent in FIG. 1, the internal baffle 74 dips lower at one side in order to better prevent oil from flowing past the baffle 74 in high g-force maneuvers. Additionally, a vent opening 84 is machined in the internal baffle 74 to allow air trapped below the baffle 74 to vent upward through the baffle 74.

The internal baffle 76, referred to herein as a second baffle, is secured to the extension portion 39 within the internal cavity 36 via tabs 85 spaced about the periphery of the internal baffle 76 (one tab 85 shown in FIG. 1). The internal baffle 76 has an outer portion 86 that curves downward toward the bottom surface 62 to redirect oil sloshing against the bottom surface of the internal baffle 76 downward.

Figure 3:
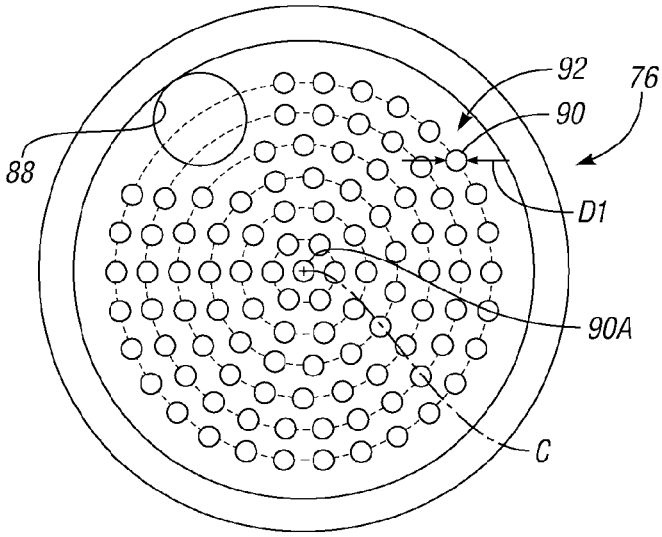
FIG. 3 is a plan view of a baffle within a lower housing portion of the dry sump oil tank assembly of FIGS. 1 and 2.

Referring to FIG. 3, the internal baffle 76 is formed or machined with a tube opening 88 through which the connecting tube 24 extends, as shown in FIG. 1. Additionally, the internal baffle 76 is formed or machined with a plurality of openings 90 arranged in a pattern and having a size, both of which are configured to efficiently minimize oil sloshing from the lower housing portion 28 above the internal baffle 76, while still allowing sufficient flow of relatively cold, deaerated oil through the openings 90 to the bottom housing portion 28. First, the pattern of openings 90 includes a center opening 90A centered with a center C of the internal baffle 76. The openings 90 are arranged about the center opening 90A in concentric circles, as indicated by the phantom lines connecting openings in each respective concentric circle. In this exemplary embodiment, there are preferably, but not limited to, one hundred openings 90, including the center opening 90A, and each opening 90 has a diameter D1 not less than 2 millimeters and not greater than 10 millimeters. It has been determined that openings of less than 2 millimeters may impede draining of relatively cold, deaerated oil back to the lower housing portion 28, while openings having diameters greater than 10 millimeters may not sufficiently retain oil within the lower housing portion 28 during sloshing, and cause the oil pickup 58 to come uncovered. The area of the openings 90 taken together is preferably, but not limited to, about 16 percent of an area of the internal cavity 36 taken at a cross-section of the cavity 36 at an upper surface 92 of the internal baffle 76. In this embodiment, because extension portion 39 is cylindrical, the relevant cross sectional area is circular with a diameter D2, and is calculated as $$\pi/4*(D2)^2.$$

While in this embodiment, the openings 90 are all of substantially identical size and are centered about the center C of the internal baffle 76, the openings 90 could vary in size within the range discussed above, and the center opening 90A need not be aligned with the center of the baffle C.

As discussed above, the dry sump oil tank assembly 14 is particularly useful for high performance applications, such as racing vehicles, and may utilize components from standard vehicle applications, thus maximizing the economies of scale of producing such components and being suited for a vehicle that may be typically used in standard driving conditions, but occasionally subjected to high performance use.

While the best modes for carrying out the invention have been described in detail, those familiar with the art to which this invention relates will recognize various alternative designs and embodiments for practicing the invention within the scope of the appended claims.

The invention claimed is:

1. A dry sump oil tank assembly for a vehicle comprising:

a housing defining an internal cavity; wherein the housing is configured with a laterally-extending portion to add lateral volume to the internal cavity;

at least one internal baffle attached to the housing within the internal cavity below the laterally-extending portion and configured to reduce sloshing of oil within the cavity;

an oil inlet above a bottom surface of the housing and below the laterally-extending portion; and an air separator above the laterally-extending portion with a positive crankcase ventilation system and an oil measuring device mounted to the air separator.

2. The dry sump oil tank assembly of claim 1, wherein the at least one internal baffle includes an integral annular baffle angled toward the bottom surface of the housing from an outer periphery to an inner periphery of the integral annular baffle; and wherein the integral annular baffle has a vent opening to allow air to vent through the vent opening.

3. A dry sump oil tank assembly for a vehicle comprising:

a housing defining an internal cavity; wherein the housing is configured with a laterally-extending portion to add lateral volume to the internal cavity;

at least one internal baffle attached to the housing within the internal cavity below the laterally-extending portion and configured to reduce sloshing of oil within the cavity;

an oil inlet above a bottom surface of the housing;

an air separator with a positive crankcase ventilation system and an oil measuring device mounted to the air separator; and wherein the at least one internal baffle includes a baffle secured to the housing;

wherein the baffle has openings arranged in concentric circles; wherein the openings each have a diameter not less than approximately 2 millimeters and not more than approximately 10 millimeters; and wherein the openings have a total area of approximately 16 percent of an area of the internal cavity at the at least one baffle.

4. The dry sump oil tank of claim 1, wherein the housing has a generally noncylindrical upper housing portion, a generally cylindrical lower housing portion, and a generally cylindrical middle housing portion therebetween; wherein the laterally-extending portion is in the upper housing portion and extends laterally outward further than the middle and lower housing portions;

wherein the at least one baffle includes:

a first annular baffle connected within the upper housing portion;

a second baffle secured to the middle housing portion; wherein the second baffle has openings arranged in concentric circles about a center of the second baffle; and wherein the first annular baffle and the second baffle minimize sloshing of oil out of the lower housing portion.

5. The dry sump oil tank assembly of claim 4, wherein the oil inlet is at a side of the lower housing portion.

6. The dry sump oil tank assembly of claim 4, wherein the air separator has internal baffling defining a spiraling flow path to deaerate and direct oil toward the lower housing portion.

7. The dry sump oil tank of claim 4, further comprising:

a connecting hose;

wherein the an air separator is configured for separating entrained air from the oil; wherein the connecting hose is operatively connected to the lower housing portion and to the air separator for routing the oil from the lower housing portion to the air separator; wherein the air separator is further configured for separating oil from the positive crankcase ventilation system;

wherein the upper housing portion is operatively connected between the air separator and the lower housing portion; wherein the connected lower and upper housing portions and the air separator at least partially define the internal cavity; wherein the oil inlet is on a lateral portion of the lower housing portion; and wherein the laterally-extending portion extends laterally outward further than the air separator.

8. The dry sump oil tank of claim 7, wherein the lateral volume of the laterally-extending portion is nonuniformly distributed within the upper housing portion.

9. A dry sump oil tank assembly for a vehicle comprising:

a housing defining an internal cavity; wherein the housing is configured with a laterally-extending portion to add lateral volume to the internal cavity;

at least one internal baffle attached to the housing within the internal cavity below the laterally-extending portion and configured to reduce sloshing of oil within the cavity;

an oil inlet above a bottom surface of the housing and below the laterally-extending portion;

an air separator with a positive crankcase ventilation system and an oil measuring device mounted to the air separator; and a connecting hose operatively connected to the oil inlet and to the air separator and that routes oil from the oil inlet to the air separator.

* * * * *